US007585260B2

(12) United States Patent
Ma

(10) Patent No.: US 7,585,260 B2
(45) Date of Patent: Sep. 8, 2009

(54) MULTIFUNCTIONAL DUMBBELL ASSEMBLY

(76) Inventor: Shaowei Ma, Room 604, Building 3, 168 Hongqiao Rd., Shanghai 200030 (CN)

( * ) Notice: Subject to any disclaimer, the term of this patent is extended or adjusted under 35 U.S.C. 154(b) by 0 days.

(21) Appl. No.: 12/095,939

(22) PCT Filed: Dec. 19, 2005

(86) PCT No.: PCT/CN2005/002237

§ 371 (c)(1),
(2), (4) Date: Jun. 3, 2008

(87) PCT Pub. No.: WO2007/065310

PCT Pub. Date: Jun. 14, 2007

(65) Prior Publication Data

US 2008/0287273 A1 Nov. 20, 2008

(30) Foreign Application Priority Data

Dec. 8, 2005 (CN) ..... 2005 10111238

(51) Int. Cl.
*A63B 21/072* (2006.01)
*A63B 21/02* (2006.01)

(52) U.S. Cl. ..... 482/108; 482/106; 482/126

(58) Field of Classification Search ..... 482/81, 482/82, 106–108, 126, 122, 124
See application file for complete search history.

(56) References Cited

U.S. PATENT DOCUMENTS 4,778,173 A * 10/1988 Joutras ..... 482/82
5,135,455 A * 8/1992 King et al. ..... 482/108

(Continued)

FOREIGN PATENT DOCUMENTS

CN 2372007 Y 4/2000

(Continued)

OTHER PUBLICATIONS

International Search Report of International Application No. PCT/CN2005/002237.

(Continued)

*Primary Examiner*—Loan H Thanh
*Assistant Examiner*—Allana Lewin
(74) *Attorney, Agent, or Firm*—Hamre, Schumann, Mueller & Larson, P.C.

(57) ABSTRACT

A multifunctional dumbbell assembly is provided, which comprises a dumbbell body and a handle strap which is detachably connected to the dumbbell body. The dumbbell body includes a handle, a first head and a second head. The heads are fixed to the opposite ends of the handle respectively. The handle strap includes a strap and two connectors which are connected to the ends of the strap respectively. Each of the first head and the second head includes: an end cover covering an end of the dumbbell body; a first coupling member having a central through hole and a cavity, an arc groove being formed in the cavity; and a second coupling member having clutch block (151) at one end, the shape of which is complementary to that of the cavity in the first coupling member, further having connector attachment portions, the second coupling member being also provided with a through hole. The dumbbell assembly is convenient and safe for use. In addition, it provides an additional exercise function.

9 Claims, 12 Drawing Sheets

U.S. PATENT DOCUMENTS

| | | | | |
|---|---|---|---|---|
| 5,180,352 | A * | 1/1993 | Sreter | 482/108 |
| 5,203,753 | A * | 4/1993 | Rothhammer | 482/111 |
| 5,242,350 | A * | 9/1993 | Chang | 482/108 |
| 2001/0018385 | A1* | 8/2001 | Chen | 482/123 |
| 2004/0005969 | A1* | 1/2004 | Chen | 482/107 |
| 2007/0184945 | A1* | 8/2007 | Lin | 482/107 |

FOREIGN PATENT DOCUMENTS

| | | | |
|---|---|---|---|
| CN | 2707314 | Y | 7/2005 |
| CN | 1663639 | A | 9/2005 |
| JP | 10-201876 | A | 8/1998 |

OTHER PUBLICATIONS

International Search Report of International Application No. PCT/CN2005/002237, Aug. 24, 2006.

* cited by examiner

MULTIFUNCTIONAL DUMBBELL ASSEMBLY

FIELD OF THE INVENTION

This invention relates to a dumbbell, in particular, to a multifunctional dumbbell assembly.

BACKGROUND OF THE INVENTION

Nowadays, a dumbbell with a handle strap is available in the market, in which the handle strap is connected to opposite ends of the handle of the dumbbell. A user, who is going to do walking/running exercise, can hold the dumbbell handle with his hand which is constrained by the strap, and can do an exercise with a dumbbell in his hand as his hand sways forwardly and backwardly. At this time, the handle strap can prevent the dumbbell from slipping off and provide a sense of safety. The handle strap can be fixedly or detachably connected to the dumbbell handle. In a detachable connection, the dumbbell becomes a conventional one so long as the handle strap is detached therefrom.

However, in the case of the existing dumbbells with a detachable handle strap, it is necessary to take down the whole head portions in order to connect or disconnect the handle strap to/from the dumbbell handle, which takes more time and is inconvenient in use. Moreover, the dumbbell is lack of additional functions. It is a need, therefore, to provide a dumbbell with an improved design and some more functions.

SUMMARY OF THE INVENTION

In order to overcome the deficiencies of the existing dumbbell, the object of the invention is to provide a multifunctional dumbbell assembly which can be quickly assembled and disassembled and provide additional exercise functions.

In order to achieve the object, the invention provides a multifunctional dumbbell assembly. It comprises a dumbbell body and a handle strap, which is detachably connected to the dumbbell body. The dumbbell body includes a handle, a first head and a second head. The heads are fixed to the opposite ends of the handle respectively. The handle strap includes a strap and two connectors which are connected to the ends of the strap respectively. Each of the first head and the second head includes: an end cover covering an end of the dumbbell body; a first coupling member having a through hole and a cavity, an arc groove being formed in the cavity; and a second coupling member having a clutch block at one end, the shape of which is complementary to that of the cavity in the first coupling member, further having connector attachment portions, the second coupling member being also provided with a through hole.

In the case of the dumbbell assembly of the invention, when it is desirable to attach or detach the handle strap or the additional exercise member, it is unnecessary to take the whole dumbbell heads down and it will be sufficient to move the heads a little out. Therefore, it is possible to rapidly attach or detach the handle strap or the additional exercise member to/from the dumbbell body, so that it is convenient for use. In addition, the dumbbell assembly of the invention has a dual-functional handle, besides the functions of a conventional dumbbell and a dumbbell with a handle strap, the dumbbell assembly further provides an additional exercise function. That is, the dumbbell assembly of the invention provides increased possibilities for use so that it will meet more demands of people.

BRIEF DESCRIPTION OF THE DRAWINGS

The objects, features and advantages will become apparent in the following descriptions in detail with reference to the accompanying drawings, in which.

EMBODIMENTS

Figure 1:
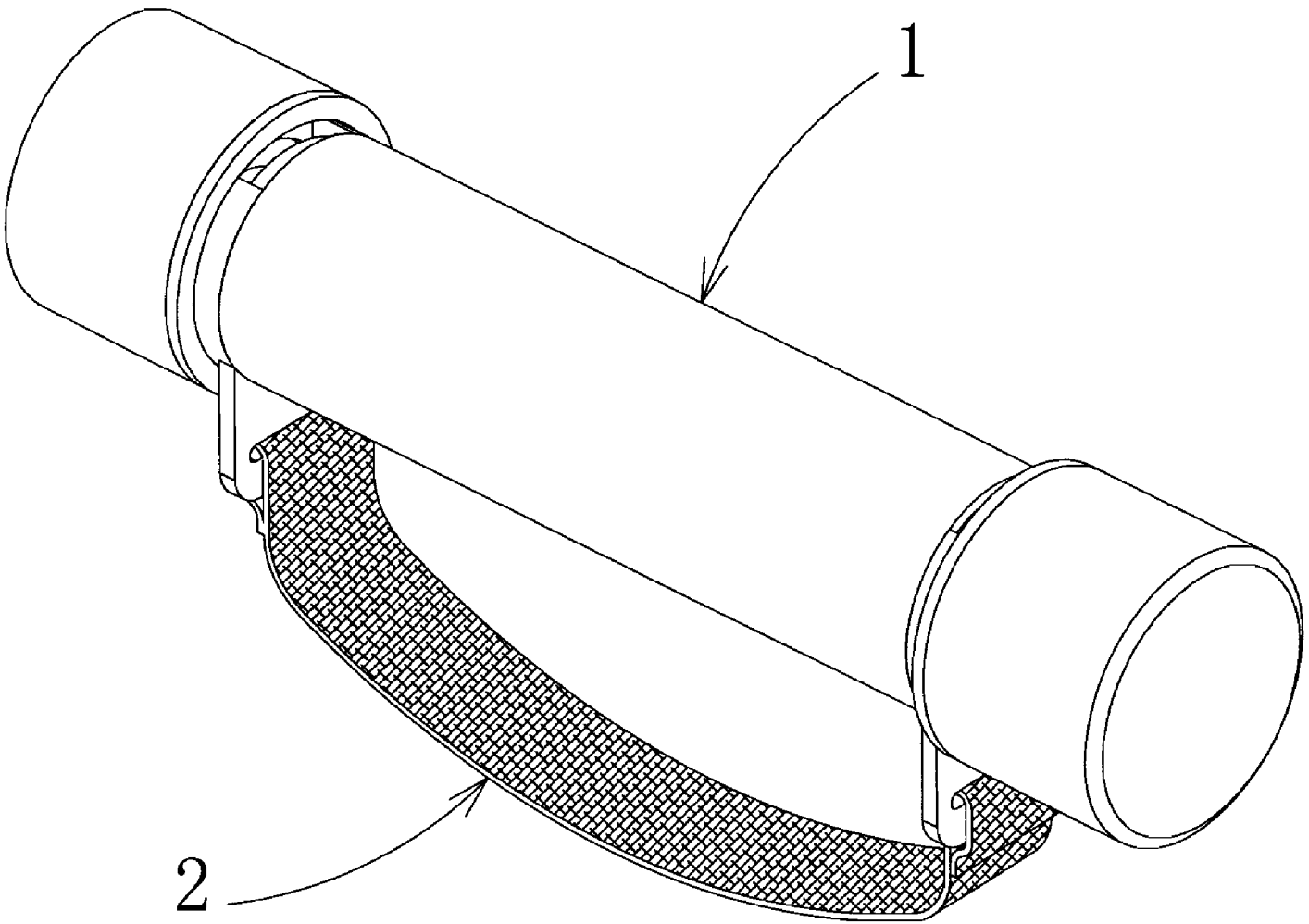
FIG. 1 is a perspective view of a dumbbell assembly with a handle strap according to a preferred embodiment of the invention.
Figure 2:
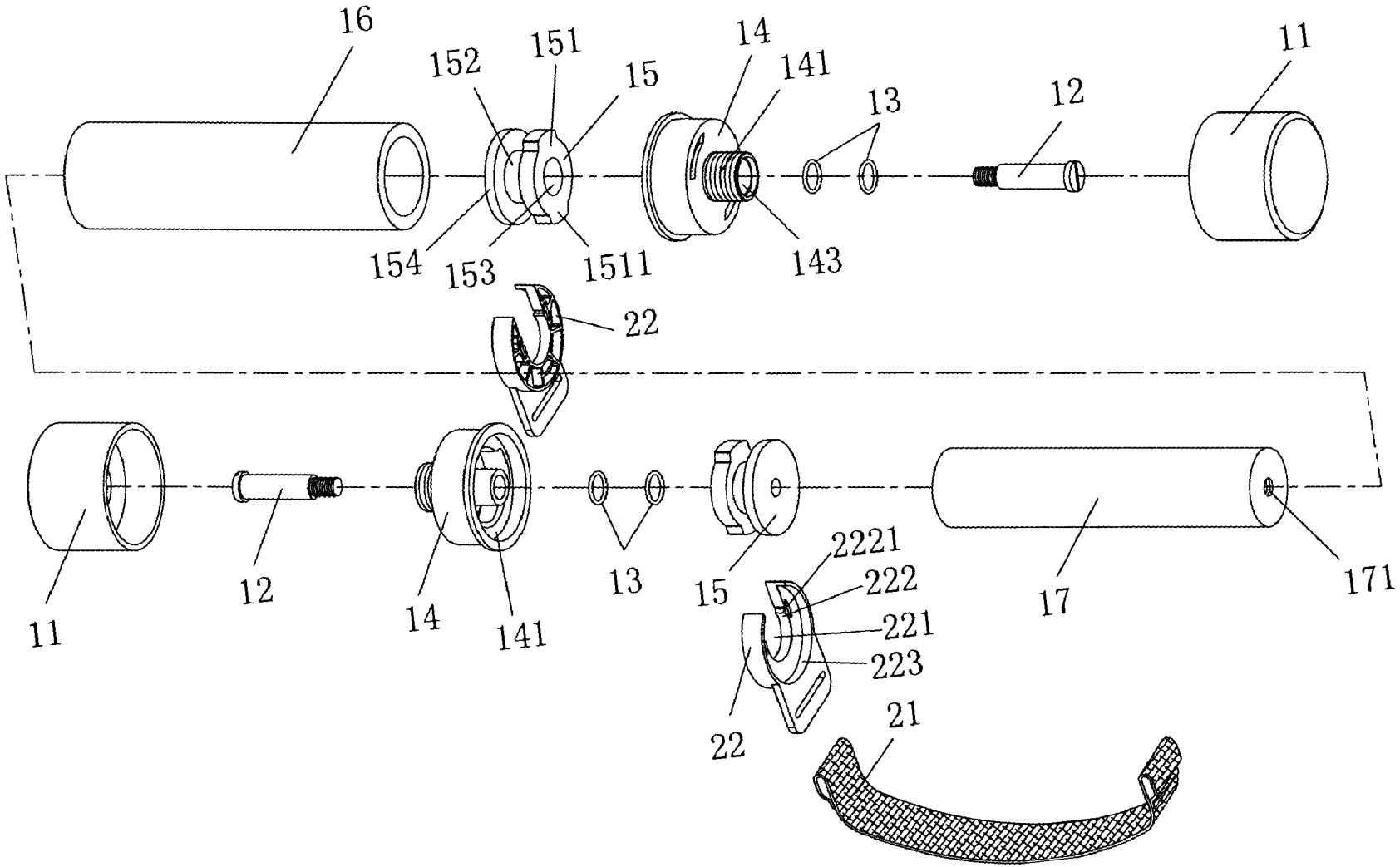
FIG. 2 is an exploded perspective view of the dumbbell assembly in FIG. 1.
Figure 3:
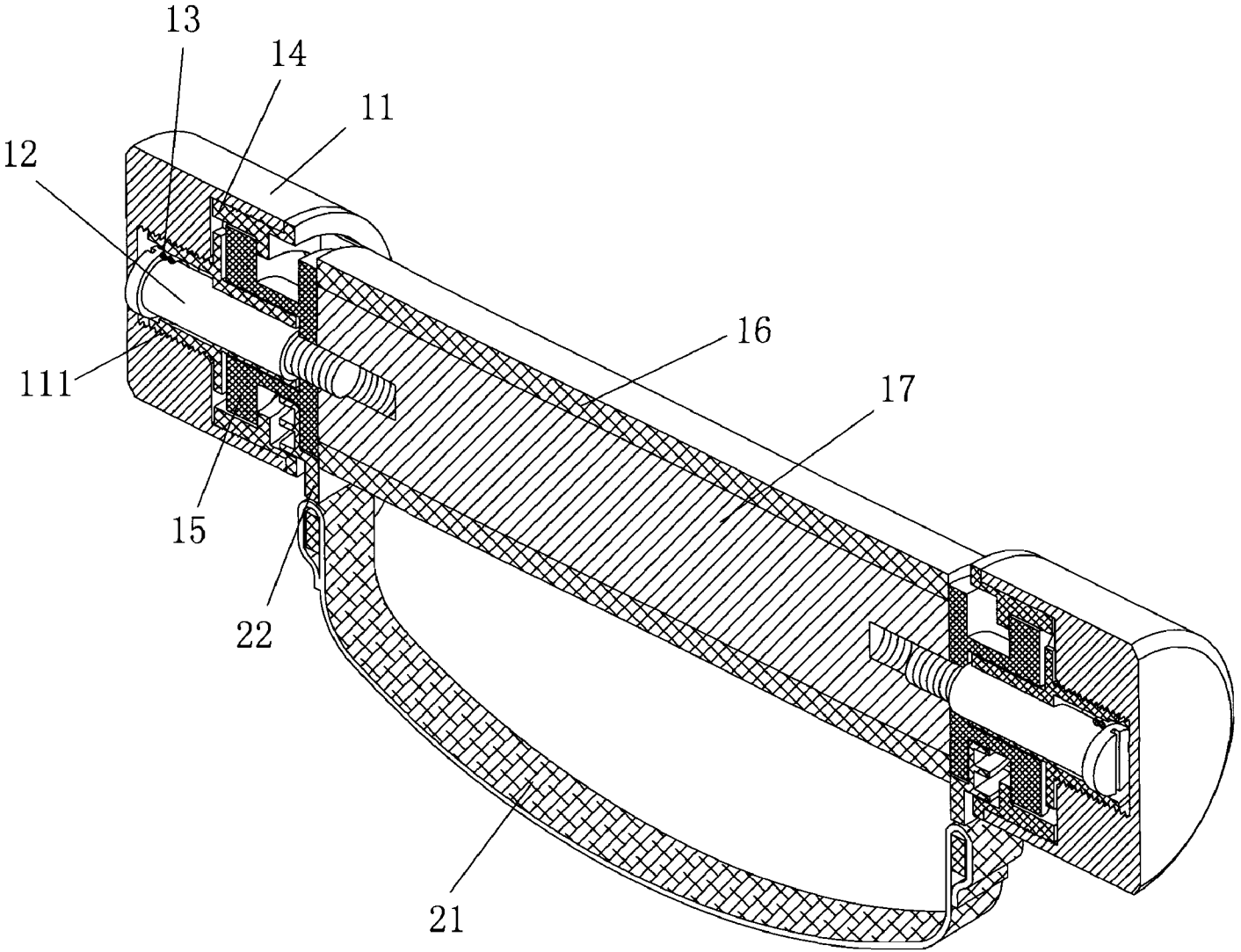
FIG. 3 is a perspective sectional view of the dumbbell assembly in FIG. 1.
Figure 4C:
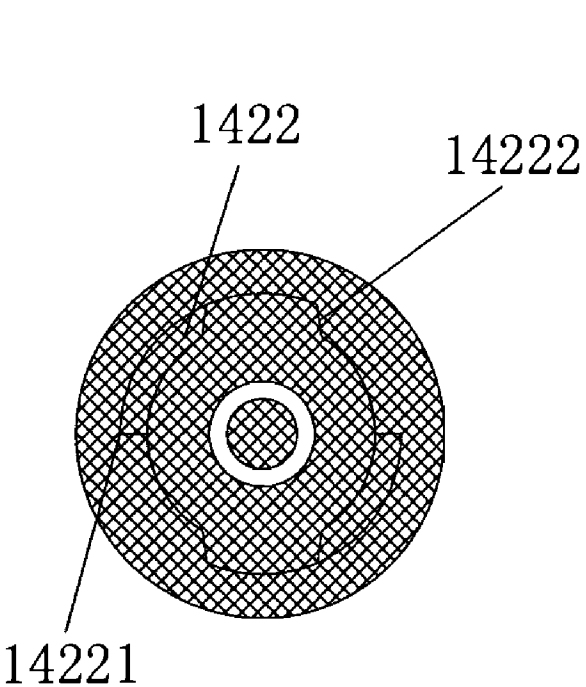
FIGS. 4*a*-4*c* is a perspective view, a front elevation view and a sectional view of a first coupling member of the dumbbell assembly, respectively.
Figure 4B:
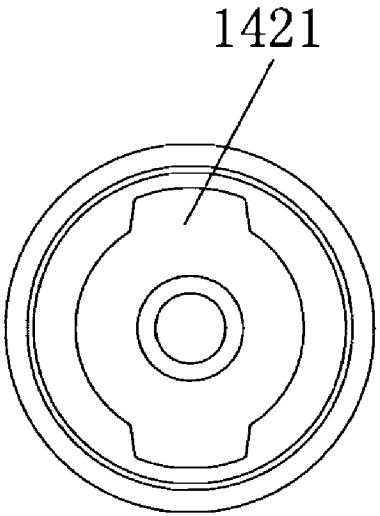
Figure 4A:
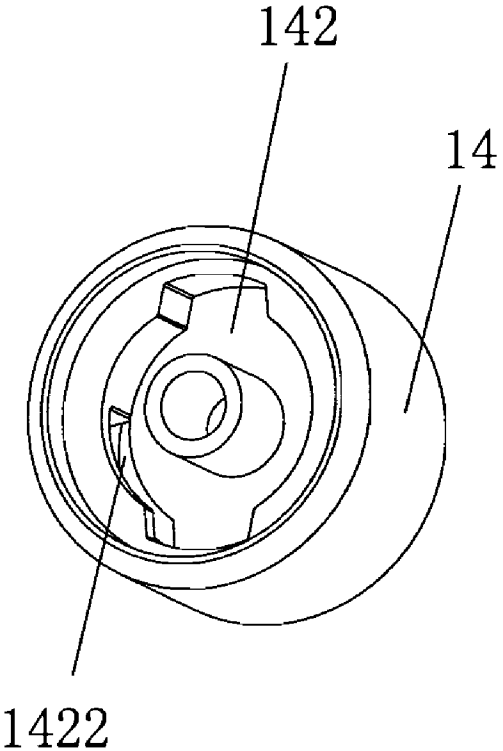

First, referring to FIG. 1, a dumbbell assembly according to a preferred embodiment of the invention includes a dumbbell body 1 and a handle strap 2. As shown in FIGS. 2 and 3, the dumbbell body 1 includes: a handle composed of a core bar 17 and a protective sleeve 16, and a first head and a second head, which are mounted to the opposite ends of the handle respectively. The first head and the second head are identical, and each includes an end cover 11, a screw 12, gaskets 13, a first coupling member 14 and a second coupling member 15.

The handle, composed of the core bar 17 and protective sleeve 16, is cylindrical-shaped, and can also be formed with an oval, a square or any other suitable sections, as desired. Each end of the core bar 17 is provided with a threaded hole 171. By the way, the handle is not necessary to be made up with two parts, and it can also be a unitary member.

End covers 11 cover the two ends of the dumbbell body. The end cover 11 can be cylindrical, or formed with a square, a polygonal or any other suitable sections, as desired. The end cover 11 can be made of iron or other suitable materials such as plastics. The end cover 11 is provided with an internal thread 111. As shown in FIGS. 2, 3 and 4*a*-4*b*, on one side of the first coupling member 14 is provided an external thread 141 to engage with the internal thread 111 in the end cover 11. It should be understood by the skilled person in the art that the positions of the external and internal threads can be exchanged with each other. In addition, it is feasible to fix the end cover 11 to the first coupling member 14 in a press fit, or even the end cover 11 and the first coupling member 14 can be formed to be a unitary member. The first coupling member 14 is provided with a through hole 143 for a fastener (screw 12) to pass therethrough. On the other side of the first coupling member 14 is provided a cavity 142, which is formed to be a circular cavity with lug-shaped slots 1421. In the cavity 142 is formed an arc groove 1422, the function of which will be described in the following.

As shown in FIGS. 2, 3 and 4*a*-4*b*, one end of the second coupling member 15 is formed to be a clutch block 151 with lugs 1511, the shape of the clutch block is complementary to that of the cavity 142 in the first coupling member 14. Because of such a complement, the clutch block 151 can be inserted into the cavity 142 if the lugs 1511 are aligned with the lug-shaped slots 1421. At this time, the first coupling member 14 and the second coupling member 15 are in a first relative position. And then, the lugs can be further moved into the arc groove 1422. The lugs 1511 can be rotated between end walls 14221 and 14222 and positioned at the two end walls. That is, the first coupling member 14 and the second coupling member 15 can be moved between the first relative position and a second relative position. The first coupling member 14 and second coupling member 15 can be separated from each other when they are in the first relative position; and they can be locked to each other when they are in the second relative position. Furthermore, other than the clutch block 151, the coupling member 15 are provided with a first connector attachment portion 152 and a second connector attachment portion 154 for receiving a connector of the handle strap 2 or a connector of an additional exercise member 3. The first connector attachment portion 152 is less in diameter than the second connector attachment portion 154. The second coupling member 15 is also provided with a through hole 153 for the screw 12 to pass therethrough.

The screw 12 is inserted through the through holes in the first coupling member 14 and second coupling member 15, and engaged into the threaded hole 171 in the core bar 17. The screw 12 can preferably be provided with gaskets 13. It should be understood that the screw 12 can be replaced with other arrangements. For example, it is practicable to directly provide complementary thread-structures on the cover 11 and the core bar 17, and to insert the core bar 17 (not the screw 12) through the through holes in the first coupling member 14 and second coupling member 15.

In FIGS. 2 and 3 is shown a handle strap 2 which includes a strap 21 and two connectors 22 attached to the opposite ends of the strap. The connector 22 is of a special design to engage with the dumbbell body 1.

In particular, the connector 22 has a U-shaped opening 221 and a partial-circle outer ring 223. The "partial-circle" means it is not a complete circle but is cut open by the U-shaped opening 221. On the opposite sides of the U-shaped opening 221 is provided an elastic leg 222 respectively, on which is provided a protuberance 2221. Surely, it is feasible that only on one side of the U-shaped opening 221 be provided an elastic leg 222 and a protuberance 2221. Such a protuberance provided on the connector 22 can prevent the connector 22 from slipping off after the connector 22 is connected to the second coupling member 15.

When connecting the connector 22 to the dumbbell body 1, the U-shaped opening 221 is firstly engaged with the first connector attachment portion 152 of the second coupling member 15. Next, the connector 22 is axially and downwardly moved by a little distance, so that the outer ring 223 is engaged with the second connector attachment portion 154 of the second coupling member 15. And then, the first coupling member 14, second coupling member 15 and connector 22 can be locked together. After the connector 22 is locked, the side of the connector 22 without the outer ring is engaged with a shoulder portion 141 of the first coupling member 14, and the outer ring 223 is limited by the second connector attachment portion 154. Moreover, after the connector 22 is locked, it can be rotated by 360 degrees about the second connector attachment portion 154.

It should be understood that the structure of the connector 22 is merely a version of the invention, and so is the matchable structure of the first coupling member 14 and second coupling member 15. It is feasible to use other simpler structures. For example, it is practicable to directly adopt a flat connector with a U-shaped (or other shape) opening and to have it be interposed between the head and the handle of the dumbbell. By doing so, it is unnecessary to provide the outer ring, elastic legs and the like on the connector, and also unnecessary to provide the two connector attachment portions with different diameters on the second coupling member 15. Although with this arrangement the connector cannot be rotated by 360 degrees about the connector attachment portions, it, anyway, is not an indispensable function.

Figure 5:
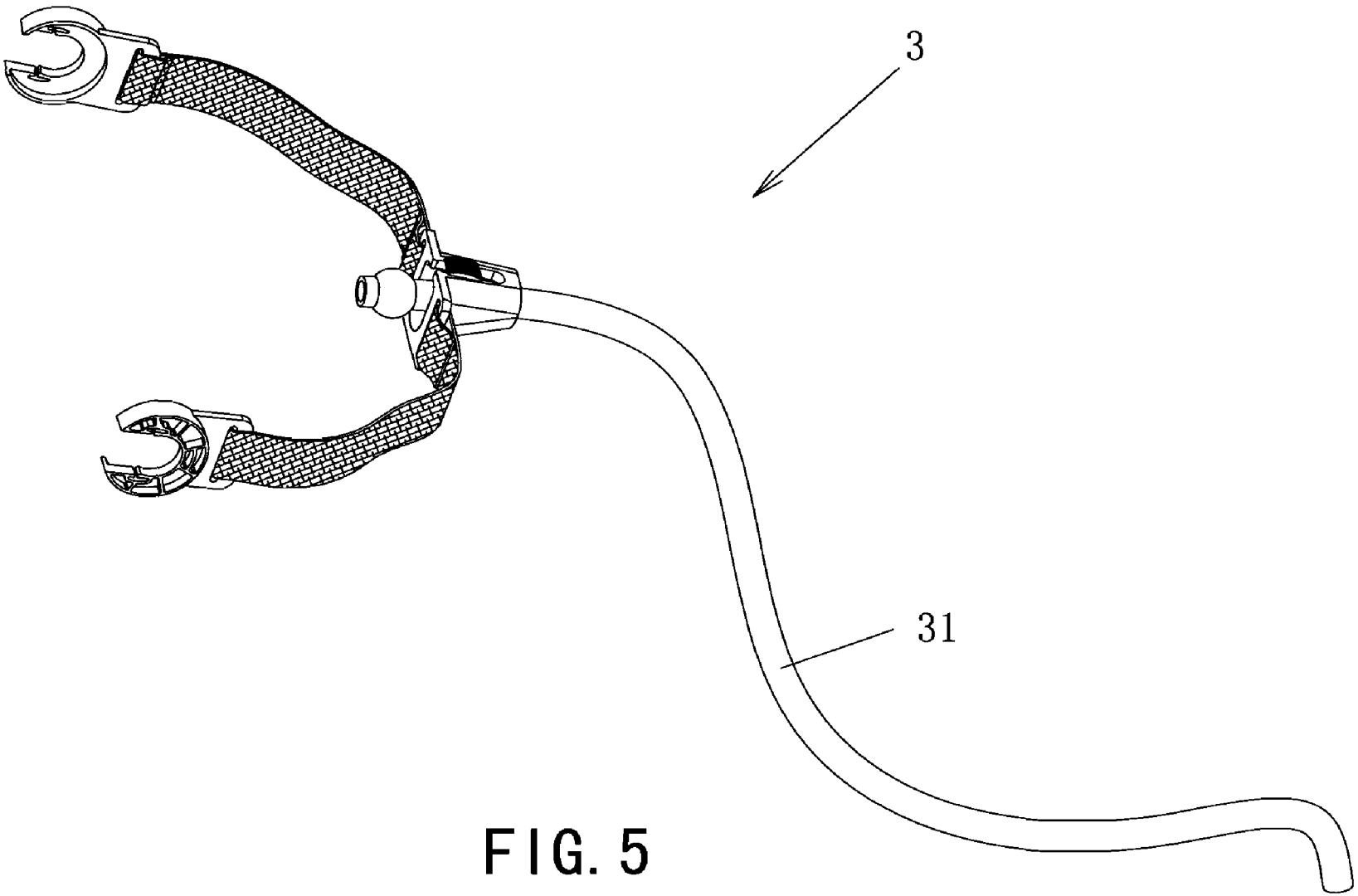
FIG. 5 is a perspective view of an additional exercise member, which is optional for the dumbbell assembly, with an elastic tubing being locked.
Figure 6:
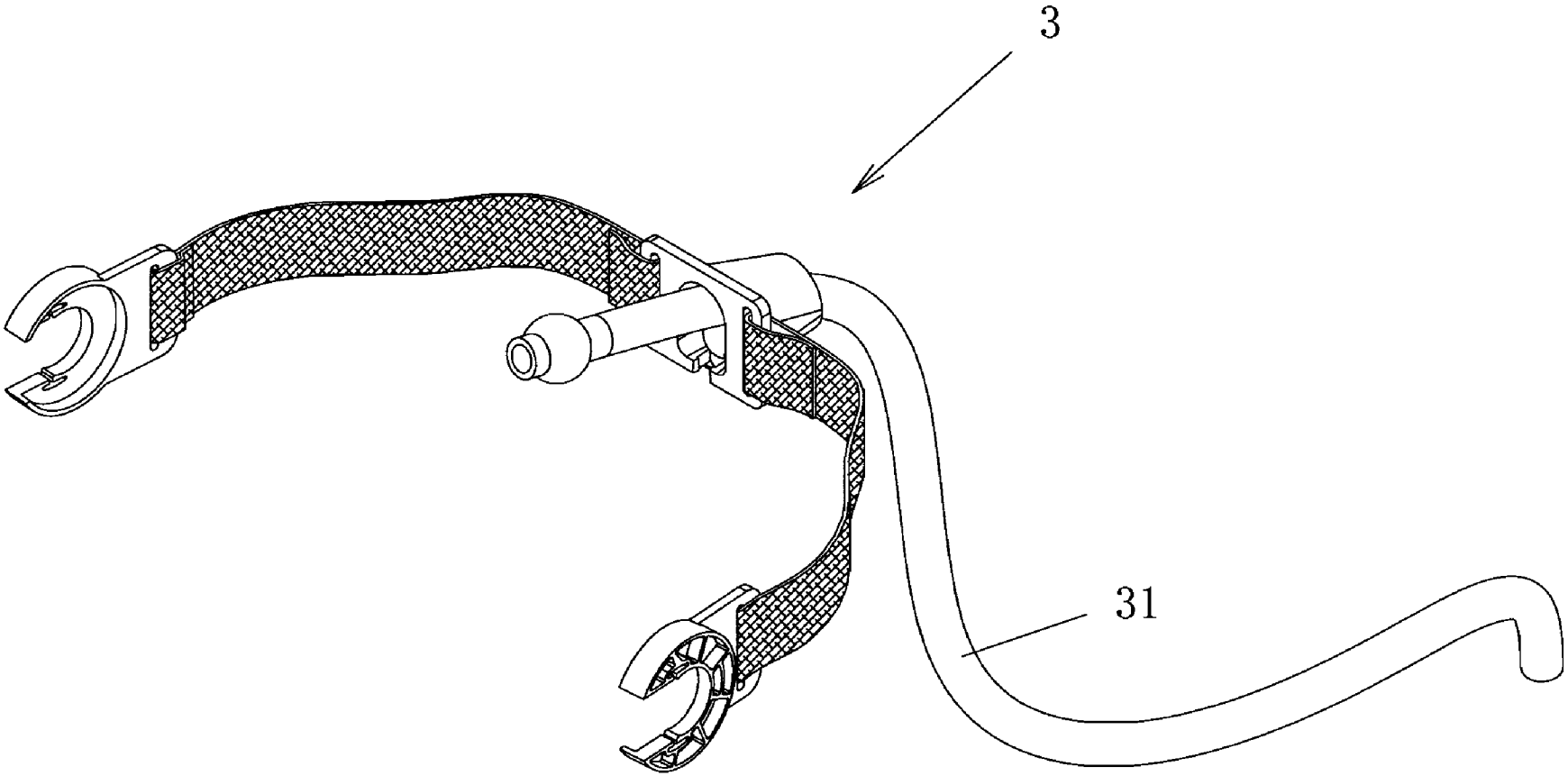
FIG. 6 is another perspective view of the additional exercise member, with the elastic tubing being unlocked and hence being adjustable.
Figure 7:
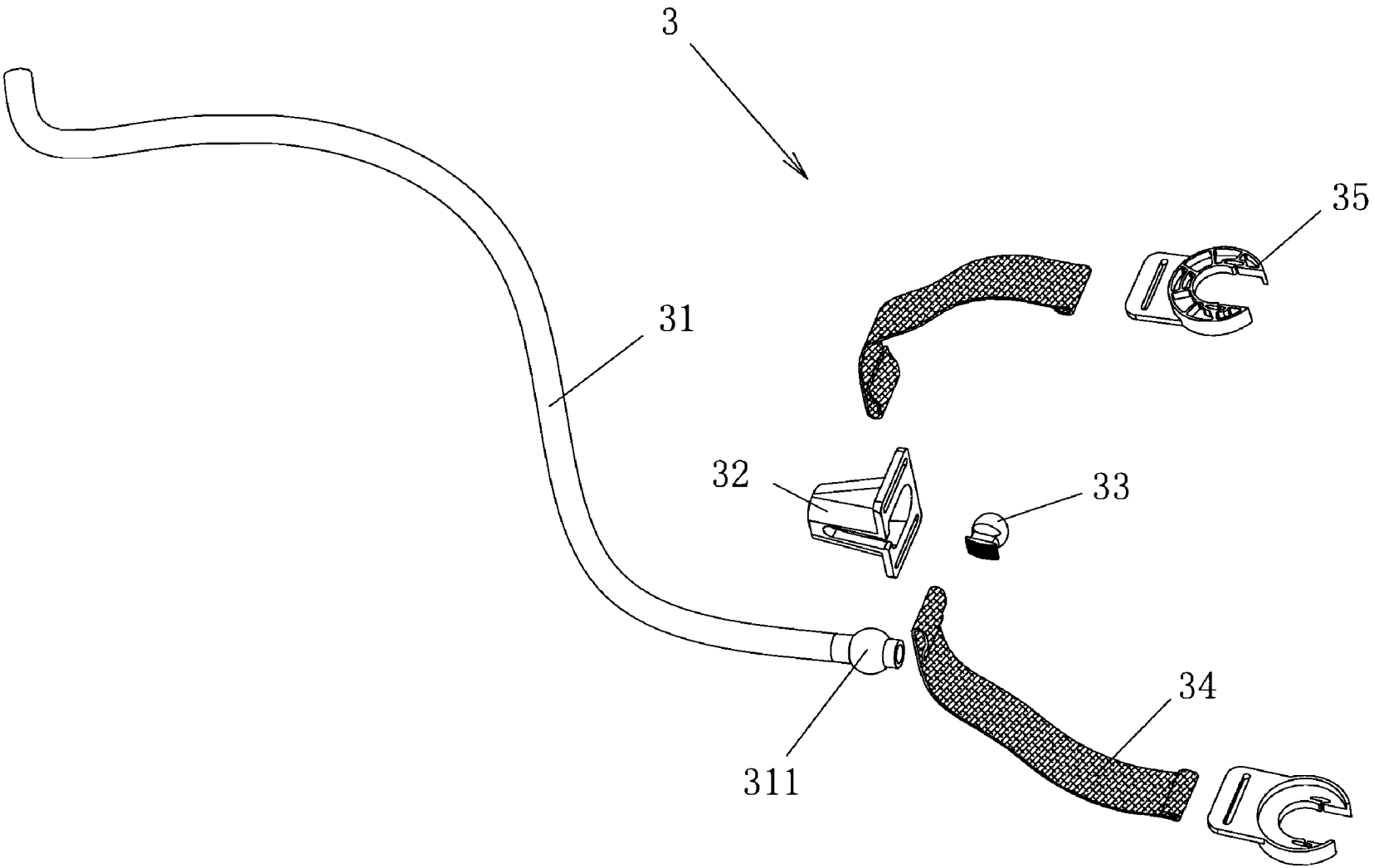
FIG. 7 is an exploded perspective view of the additional exercise member.
Figure 8C:
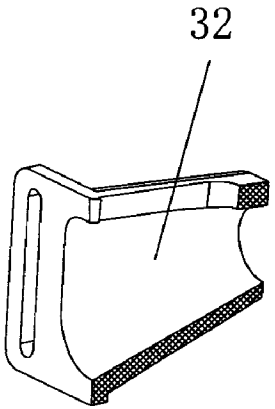
FIGS. 8*a*-8*d* is a perspective top view, a perspective bottom view, a sectional view and a front elevation view of a locking member in the additional exercise member, respectively.
Figure 8D:
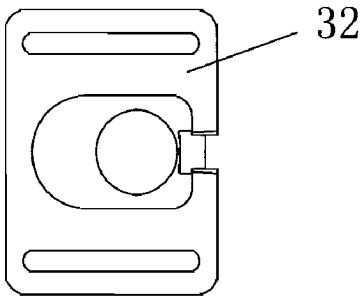
Figure 8A:
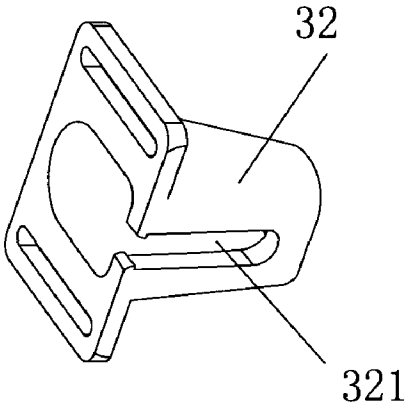
Figure 8B:
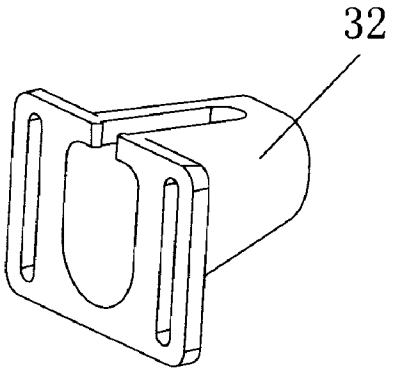

FIGS. 5-7 show perspective views of an additional exercise member 3 which is optional for the dumbbell assembly of the invention. Referring to FIG. 7, the additional exercise member mainly comprises an elastic tubing 31, a locking member 32, a catch 33, a strap 34 and connectors 35. As shown in FIG. 5, the connectors 35 are the same in configuration as the connectors 22 and are connected to the opposite ends of the strap 34 respectively. The strap 34 is passed through and connected to the locking member 32. The elastic tubing 31 is inserted into the locking member 32 and can be locked in the locking member 32 by the catch 33. In addition, if desired, the bulbous end 311 of the tubing 31 is helpful to the locking. As shown in FIG. 6, the tubing 31 can be unlocked for being adjusted in length. After the length adjustment, in order to lock the tubing, the catch 33 is slid in a slot 321 in the locking member 32. In FIGS. 8*a*-8*d*, there is shown a configuration of the locking member 32 of the additional exercise member 3.

It should be understood that in the additional exercise member 3 described above, it is the structure of the connector 35 is inventive, the remainders are of the prior art, and therefore they can be replaced by other suitable components. For example, the length adjustment can be made by using other conventional length adjustment means for tubing.

Figure 9:
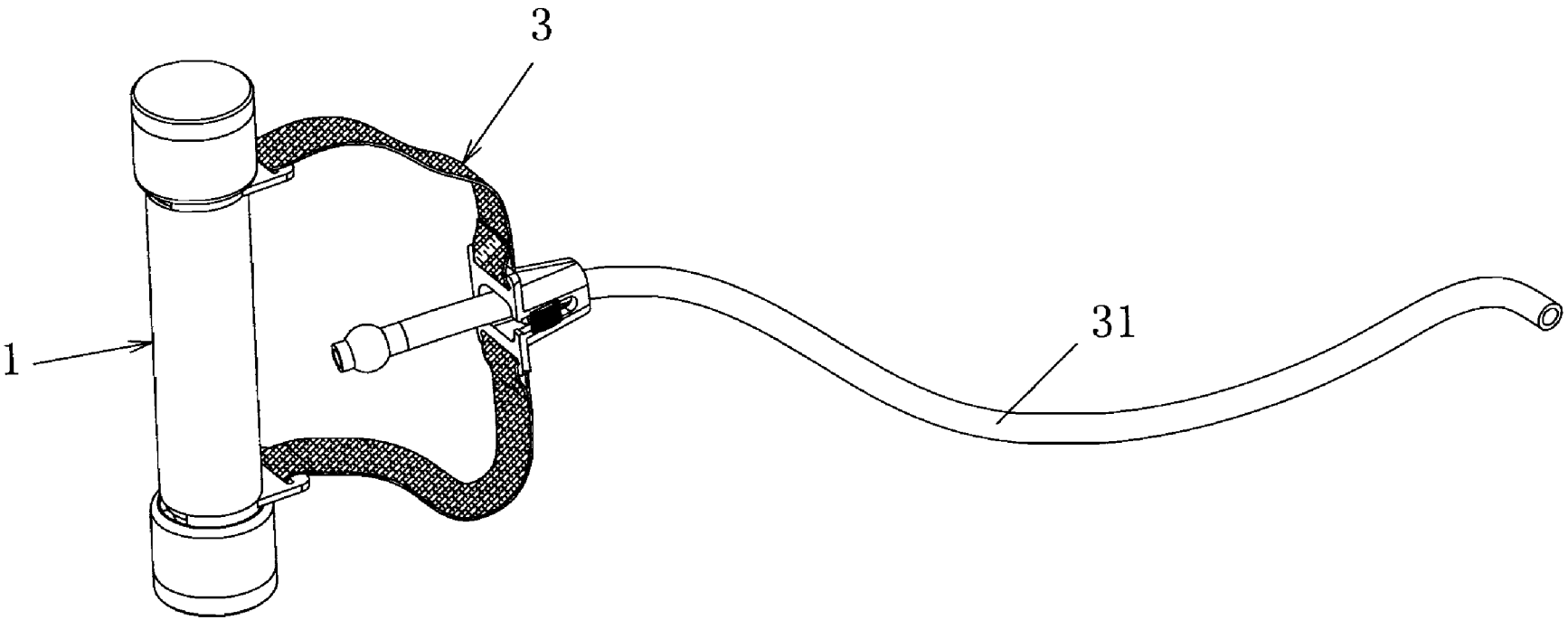
FIG. 9 is a perspective view of the additional exercise member, which has been connected to a dumbbell body.

FIG. 1 illustrates a general view of the connection between the handle strap 2 and the dumbbell body 1. FIG. 9 illustrates a general view of the connection between the additional exercise member 3 and the dumbbell body 1.

The connection of both the handle strap 2 and additional exercise member 3 to the dumbbell body 1 is implemented by means of the engagement between the connectors and dumbbell heads. Particularly, the dumbbell heads are rotated so that the lugs 1511 of the second coupling member 15 abut against the end walls of the arc groove 1422 of the first coupling member 14, and thereby the lugs 1511 of the second coupling member 15 are aligned with the lug-shaped slots 1421 of the first coupling member 14 (the first relative position of the first coupling member 14 and second coupling member 15), the dumbbell heads can be axially pulled out. When the heads are pulled out, since the engagement between the head of the screw 12 and a shoulder in the through hole 143 of the first coupling member 14 (or a shoulder in the core member 18 of the dumbbell head as described in the following) functions as a stop, and hence the heads are stopped, being pulled out by only a small distance. Next, the U-shaped opening 221 of the connectors 22 of the handle strap 2 can be connected to the connector attachment portion 152 of the second coupling member 15. At this time, the connectors 22 will not fall off in any orientation due to the blocking of the protuberances 2221 on the elastic legs 222. Still next, the dumbbell heads are axially pressed, and then the dumbbell heads are rotated to their original position (the second relative position of the first coupling member 14 and the second coupling member 15) so that the first coupling member 14, the second coupling member 15 and the connectors 22 are locked together. Thus, the handle strap 2 is firmly connected with the dumbbell body 1 as shown in FIG. 1. After the completion of the connection, a user can hold the dumbbell handle to do physical exercise, such as walking/running with the dumbbell load. If it is desired to take down the handle strap 2, it will be sufficient to operate with steps reversed to the above.

The steps for connecting the additional exercise member 3 to the dumbbell body 1 are identical to those for connecting the handle strap 2 to the dumbbell body 1. After being connected, they are as shown in FIG. 9. Then, a user can use the dumbbell assembly with the additional exercise member 3 to do exercise. For example, a user can step on a part of the elastic tubing with his foot and hold the dumbbell handle in his hand and raise the dumbbell upwardly and downwardly to do a strength exercise. By adjusting the length of the elastic tubing 31, different pulling forces can be reached.

The dumbbell handle can be called as a "dual handle", since the handle takes different effects for exercise in the above two cases.

Another embodiment of the invention is now described with reference to FIGS. 10-12, in which the same or similar components are denoted by the same reference numbers and will not be described any more.

Figure 10:
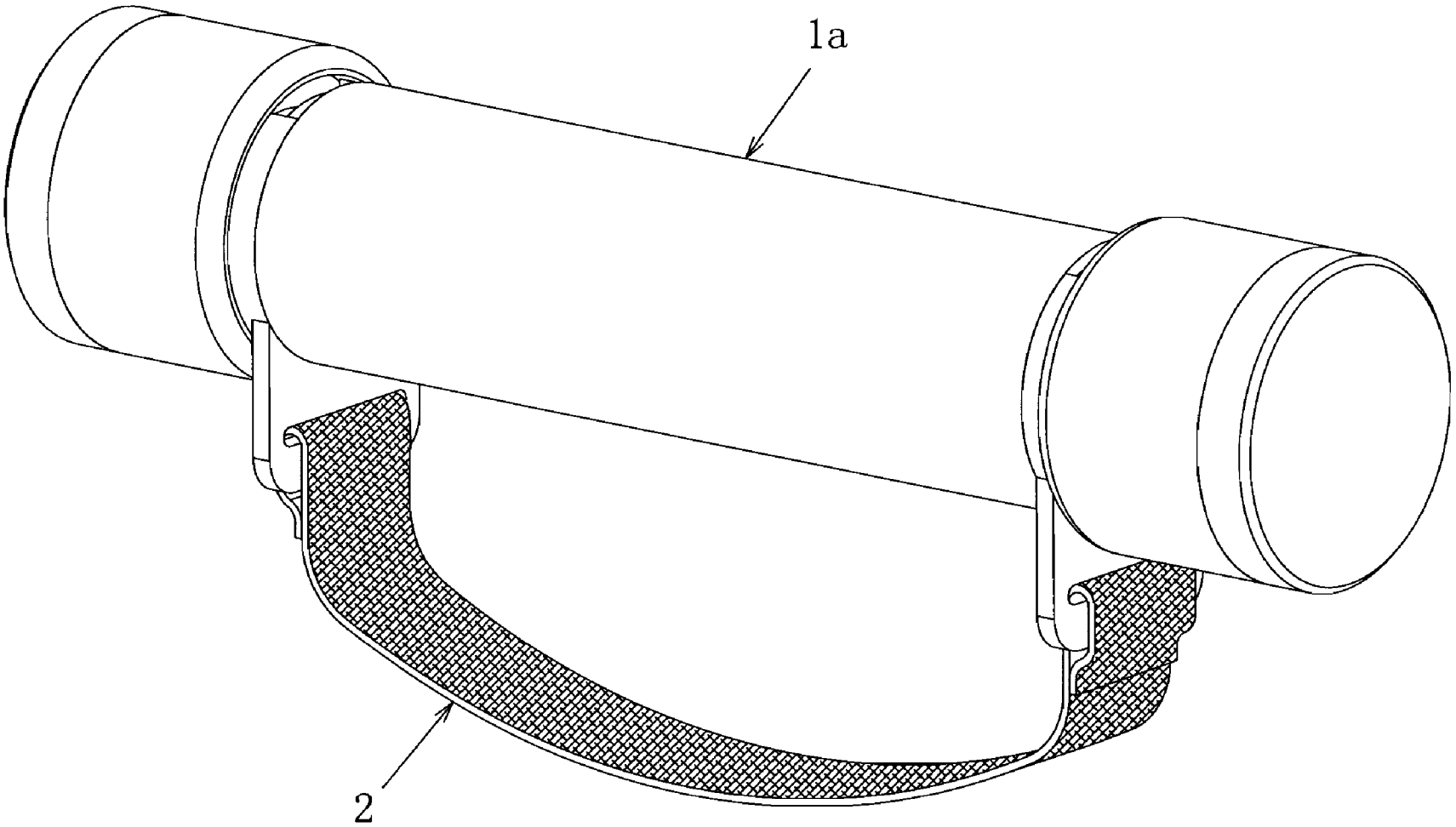
FIG. 10 is a perspective view of a dumbbell assembly with a handle strap according to another preferred embodiment of the invention.

First, referring to FIG. 10, the dumbbell assembly of this embodiment according to the invention comprises a dumbbell body 1*a* and a handle strap 2.

Figure 11:
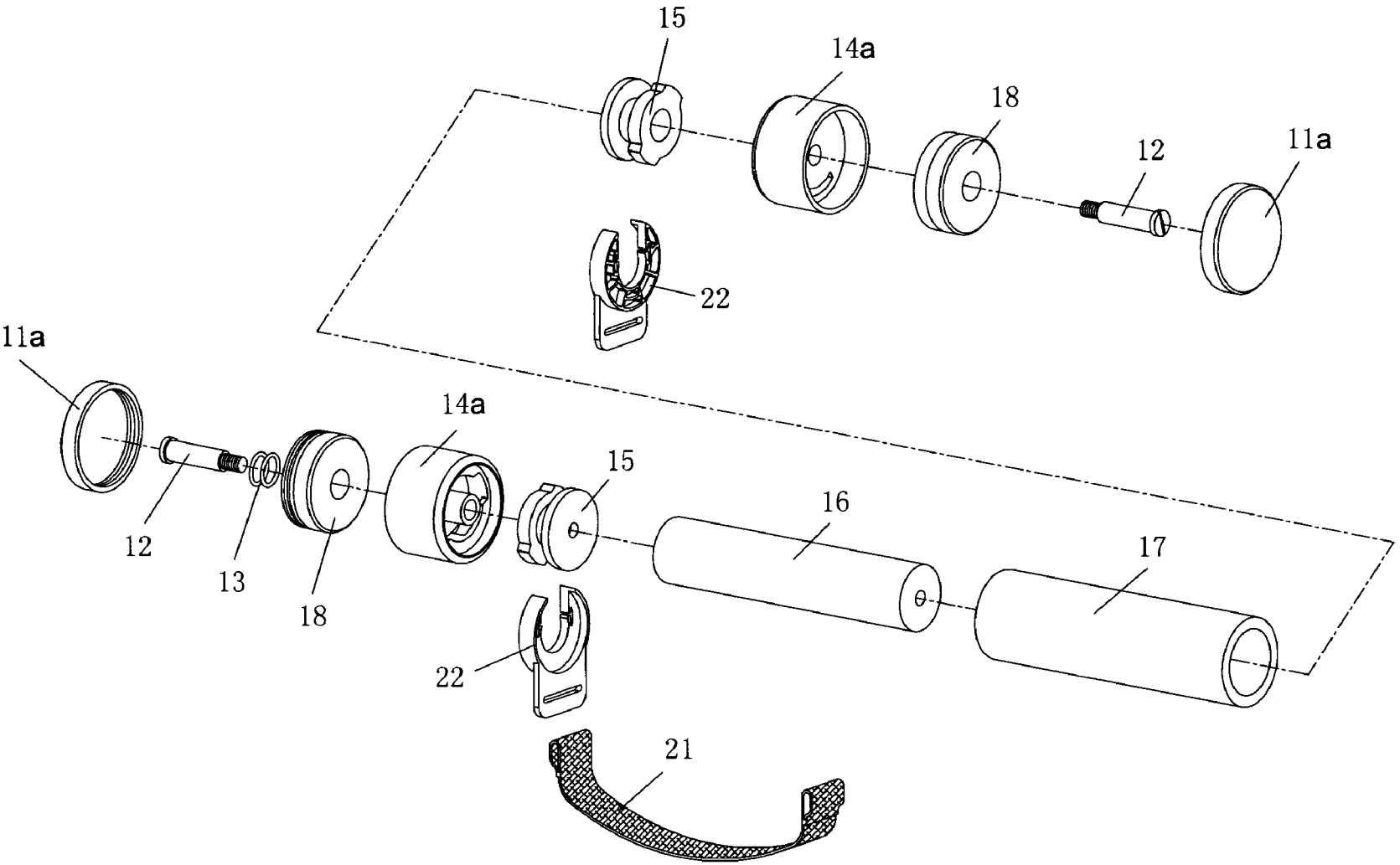
FIG. 11 is an exploded perspective view of the dumbbell assembly in FIG. 10.
Figure 12:
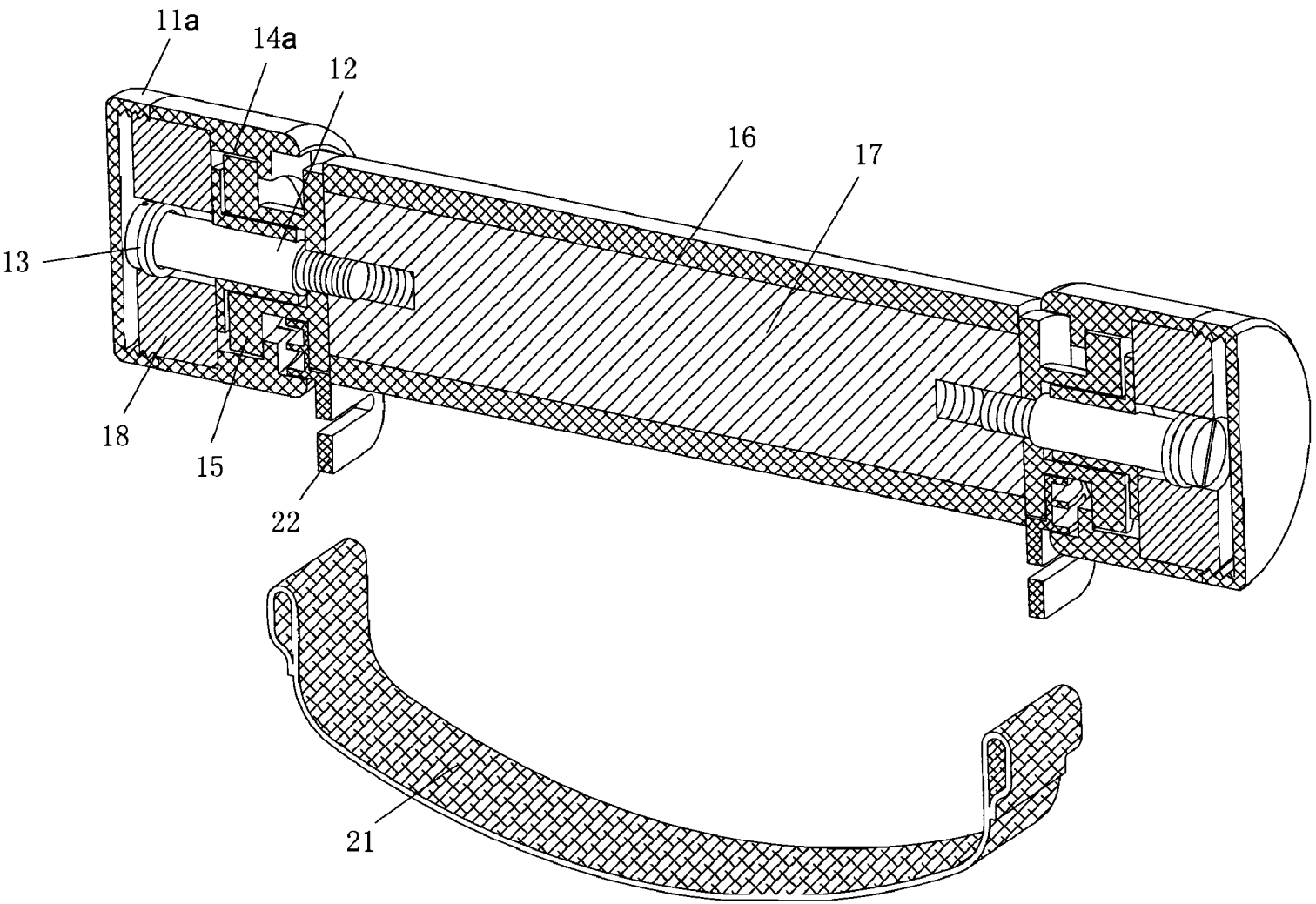
FIG. 12 is a sectional view of the dumbbell assembly in FIG. 10.

Next, referring to FIGS. 11 and 12, the dumbbell body 1*a* is different from the above dumbbell body 1 in its head structure. Particularly, in this embodiment, an end cover 11*a* and a head core 18 take the place of the end cover 11 in the above embodiment, and the first coupling member 14*a* is somewhat different in configuration from the first coupling member 14. The first coupling member 14*a* and the end cover 11*a* form together an enclosure of the head portion for receiving the head core 18.

In order to assemble the dumbbell body 1*a*, the screw 12 is inserted in sequence through the head core 18, the first coupling member 14*a* and the second coupling member 15, and is engaged into the threaded hole 171 in the core bar 17, and then the end cover 11*a* is threadedly engaged with the head core 18.

While the multifunctional dumbbell assembly of the invention has been described in detail with reference to its preferred embodiments, the skilled person in the art can conceive various equivalent modifications and/or variants based on the disclosures herein. For example, the adjustment means composed of the locking member 32 and the catch 33, and the bulbous end 311 of the tubing 31 are not indispensable, for simplification, all of them can be omitted; the configuration of the cavity 142 in the first coupling member 14 (14*a*) and the that of the clutch block 151 in the second coupling member 15 can be changed; the shape, amount and position of both lugs 1511 and lug-shaped slots 1421 can also be changed; the U-shaped opening of the connector 22 can be modified to other suitable shapes, such as circle-like shape; and the materials of the various components of the dumbbell assembly can be selected depending on different demands. Therefore, the scope of the invention is defined by the appended claims.

I claim:

1. A multifunctional dumbbell assembly comprising: a dumbbell body and a handle strap which is detachably connected to the dumbbell body, wherein the dumbbell body includes a handle, a first head and a second head, the heads are fixed to the opposite ends of the handle respectively; the handle strap includes a strap and two connectors which are connected to the opposite ends of the strap respectively. characterized in that each of the first head and the second head includes:

an end cover covering an end of the dumbbell body;

a first coupling member having a through hole and a cavity, an arc groove being farmed in the cavity; and a second coupling member having a clutch block at one end, the shape of which is complementary to that of the cavity in the first coupling member, further having connector attachment portions, the second coupling member being also provided with a through hole, wherein the connector includes a partial-circle outer ring and a U-shaped opening, the first connector attachment portion is different in diameter from the second connector attachment portion, the U-shaped opening is engaged with the first connector attachment portion, and the partial-circle outer ring is engaged with the second connector attachment portion.

2. The multifunctional dumbbell assembly of claim 1, further comprising an additional exercise member including an elastic tubing, a strap and connectors, wherein the connectors are attached to the opposite ends of the strap.

3. The multifunctional dumbbell assembly of claim 1, wherein the U-shaped opening is provided with at least one elastic leg, on which is provided a protuberance.

4. The multifunctional dumbbell assembly of claim 1, further comprising a fastener, and the fastener is inserted through the through holes in the first coupling member and second coupling member and finally engaged into the handle.

5. The multifunctional dumbbell assembly of claim 1, wherein the handle is composed of a core bar and a protective sleeve.

6. The multifunctional dumbbell assembly of claim 1, wherein the end cover is fixed to the first coupling member with a threaded connection.

7. A multifunctional dumbbell assembly comprising:

a dumbbell body and a handle strap which is detachably connected to the dumbbell body, wherein the dumbbell body includes a handle, a first head and a second head, the heads are fixed to the opposite ends of the handle respectively; the handle strap includes a strap and two connectors which are connected to the opposite ends of the strap respectively, characterized in that each of the first head and the second head includes:

an end cover covering an end of the dumbbell body;

a first coupling member having a through hole and a cavity, an arc groove being formed in the cavity;

a second coupling member having a clutch block at one end, the shape of which is complementary to that of the cavity in the first coupling member, further having connector attachment portions, the second coupling member being also provided with a through hole; and an end core, the end core is received in the first coupling member, the first coupling member and the end cover together form an enclosure of both the first head and the second head.

8. The multifunctional dumbbell assembly of claim 7, further comprising a fastener, and the fastener is inserted in sequence through the end core, the first coupling member and the second coupling member and finally engaged into the handle.

9. A multifunctional dumbbell assembly comprising a dumbbell body and a handle strap which is detachably connected to the dumbbell body, wherein the dumbbell body includes a handle, a first head and a second head, the heads are fixed to the opposite ends of the handle respectively; the handle strap includes a strap and two connectors which are connected to the opposite ends of the strap respectively, characterized in that each of the first head and the second head includes:

an end cover covering an end of the dumbbell body;

a first coupling member having a through hole and a cavity, an arc groove being formed in the cavity; and a second coupling member having a clutch block at one end, the shape of which is complementary to that of the cavity in the first coupling member, further having connector attachment portions, the second coupling member being also provided with a through hole, wherein the shape of the cavity in the first coupling member is a circle with two lug-shaped slots, the shape of the clutch block on the second coupling member is a circle with two lugs.

* * * * *